US006808425B2

(12) United States Patent
Wong

(10) Patent No.: US 6,808,425 B2
(45) Date of Patent: Oct. 26, 2004

(54) LAMP SOCKET

(76) Inventor: Bun Wong, 7th Floor, Block 2, Leader Industrial Centre, 188-202 Texaco Road, Tsuen Wan, New Territories (HK)

( * ) Notice: Subject to any disclaimer, the term of this patent is extended or adjusted under 35 U.S.C. 154(b) by 0 days.

(21) Appl. No.: 10/226,210

(22) Filed: Aug. 23, 2002

(65) Prior Publication Data

US 2003/0040225 A1 Feb. 27, 2003

(30) Foreign Application Priority Data

Aug. 24, 2001 (GB) ..... 0120695

(51) Int. Cl.[7] ..... H01R 25/00
(52) U.S. Cl. ..... 439/648; 439/649
(58) Field of Search ..... 439/641, 644, 439/648, 639, 642, 666; 362/228, 249

(56) References Cited

U.S. PATENT DOCUMENTS 973,199 A * 10/1910 Holden ..... 439/648
1,642,626 A * 9/1927 Paiste ..... 439/648
1,687,569 A * 10/1928 William ..... 200/51.17
4,667,276 A * 5/1987 Cheng ..... 362/249
4,850,900 A * 7/1989 Yarmark ..... 439/648
5,518,425 A 5/1996 Tsai
5,547,392 A 8/1996 Cheng et al.
5,569,044 A 10/1996 Huang
5,964,615 A 10/1999 Endres
6,162,100 A * 12/2000 Al-Turki ..... 439/644

* cited by examiner

*Primary Examiner*—Hien Vu
(74) *Attorney, Agent, or Firm*—Leydig, Voit & Mayer, Ltd.

(57) ABSTRACT

A lamp socket for holding an electric light bulb having a screw-threaded base, comprising a body defining therein a receptacle for receiving and locating the light bulb by its base about an axis, and two moulded part-cylindrical socket members located within the receptacle and arranged in an annular manner about the axis. The socket members have on their inner surfaces screw threads for engaging the base of the light bulb. A pair of electrical contacts is arranged within the receptacle for contact by respective side and end terminals on the base of the light bulb. The body is formed by two separate parts, with the first part formed with an aperture to define an open end of the receptacle and the second part having a solid wall to define a closed end of the receptacle.

15 Claims, 11 Drawing Sheets

LAMP SOCKET

The present invention relates to a lamp socket for locating an electric light source that has a screw-threaded base, such as a light bulb or a light tube generally known as an energy saving lamp.

BACKGROUND OF THE INVENTION

In order to hold an electric light bulb or tube having a screw-threaded base, a typical lamp socket includes a receptacle in which a screw-threaded collar is located. Conventionally, the collar is made of copper or copper alloy that is electrically conductive, for direct electrical connection with the base as one terminal.

The process of making a screw-threaded metal collar is relatively complicated and/or time consuming, usually requiring separate processes in production for the formation of the body of the collar and the formation of screw threads therein. Also, copper, like most other metals, is relatively or becoming expensive.

The invention seeks to mitigate or at least alleviate such problems and shortcomings by providing an improved lamp socket.

SUMMARY OF THE INVENTION

According to the invention, there is provided a lamp socket for holding at least one electric light source having a screw-threaded base, comprising a body defining therein a receptacle for receiving and locating a said light source by its base about an axis, and at least two separately moulded part-cylindrical socket members located within the receptacle and arranged in an annular manner about the axis. The socket members have on their inner surfaces screw threads for engaging the base of a said light source. A pair of electrical contacts is arranged within the receptacle for contact by respective side and end terminals on the base of a said light source. The body is formed by two separate parts, with the first part formed with an aperture to define an open end of the receptacle and the second part having a solid wall to define a closed end of the receptacle.

It is preferred that each socket member has a body of a thickness similar to the depth of its screw threads.

Preferably, the socket members have substantially the same construction as one another.

More preferably, each socket member has opposite arcuate edges and its screw threads are formed at a substantially central position between the two edges.

The socket members may be located within the receptacle at different levels with respect to the axis such that their screw threads at opposite ends are aligned as between adjacent socket members.

In a preferred embodiment, a pair of said socket members is incorporated, which are located on diametrically opposite sides within the receptacle.

More preferably, each socket member extends over an angle slightly short of 180°.

It is preferred that the socket members are arranged in an annular manner to form substantially a split collar.

In a preferred embodiment, the receptacle has a generally cylindrical inner surface formed with part-cylindrical recesses locating therein the socket members respectively.

More preferably, opposite ends of each socket member and the corresponding recess have respective inclined surfaces for inter-engagement to hold the socket member in the recess.

It is preferred that each socket member has opposite arcuate peripheral sides that are asymmetrical compared with each other and the corresponding recess has a matching shape, whereby the orientation at which the socket member is fitted within the recess is determined.

It is further preferred that one arcuate peripheral side of each socket member is formed with a notch and the corresponding recess is formed with a protrusion matching with the notch for engagement therewith to determine the orientation at which the socket member is fitted within the recess.

In a specific construction, the lamp socket is for holding two said electric light sources, in that the body has opposite ends defining two said receptacles facing in opposite directions for locating said light sources respectively, with a first end of each body part formed with a said aperture to define an open end of one receptacle and a second end of each body part having a said solid wall to define a closed end of the other receptacle.

More specifically, the two body parts have substantially the same construction as each other.

It is preferred that the body and the socket members are moulded from plastics material.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
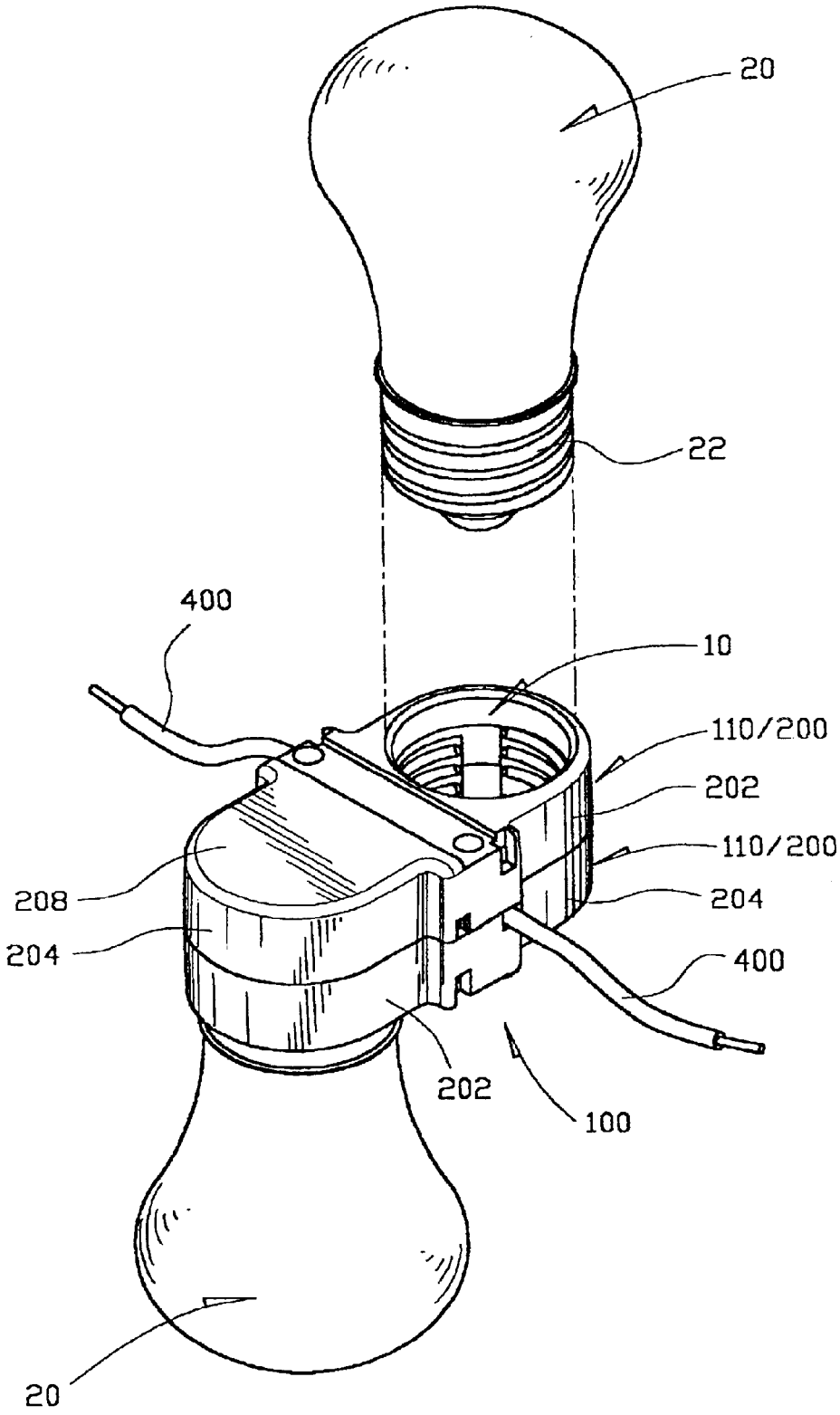
FIG. 1 is a perspective view of a first embodiment of a lamp socket in accordance with the invention, said socket having a body defining a pair of receptacles for holding respective light bulbs and including a pair of socket members located within each receptacle.
Figure 2:
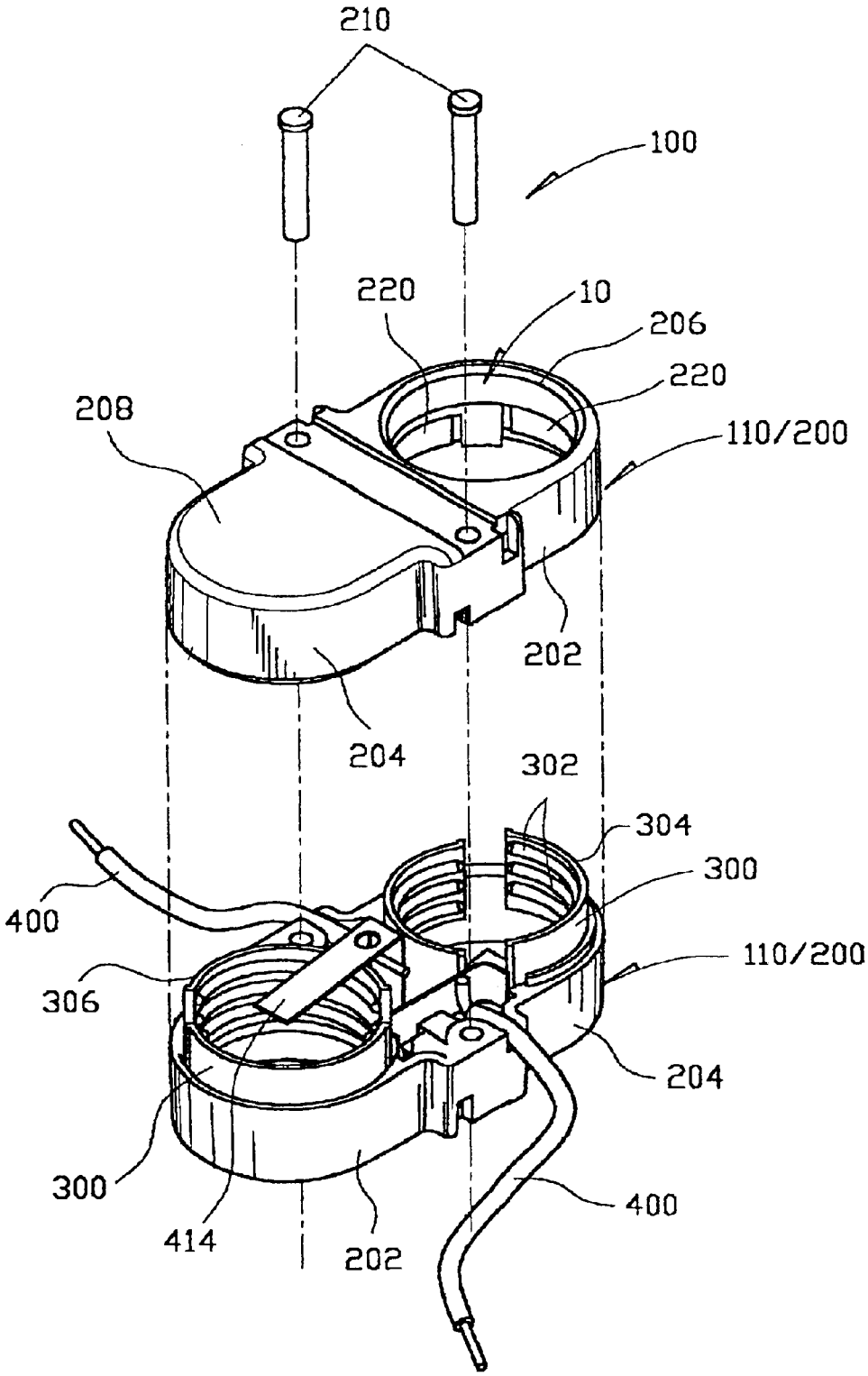
FIG. 2 is a partially exploded perspective view of the lamp socket of FIG. 1, revealing the internal construction and showing that the body is formed by two parts.
Figure 3:
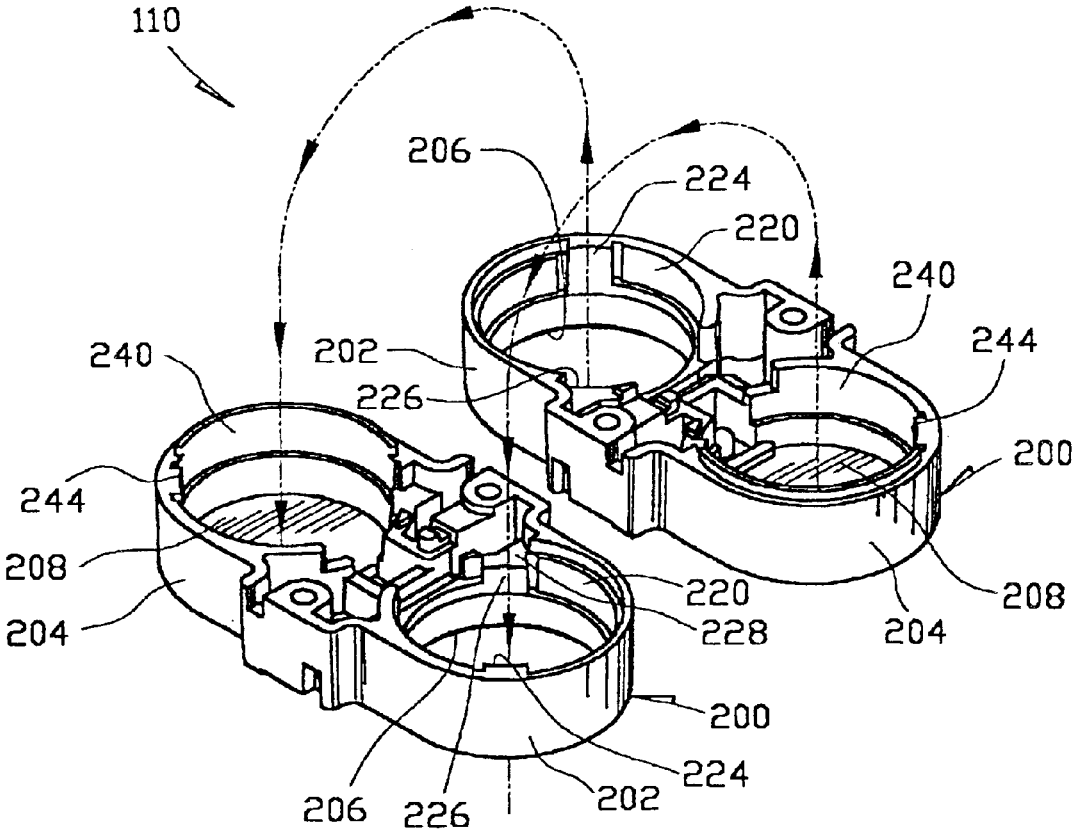
FIG. 3 is an exploded perspective view of the two body parts of FIG. 2.
Figure 3A:
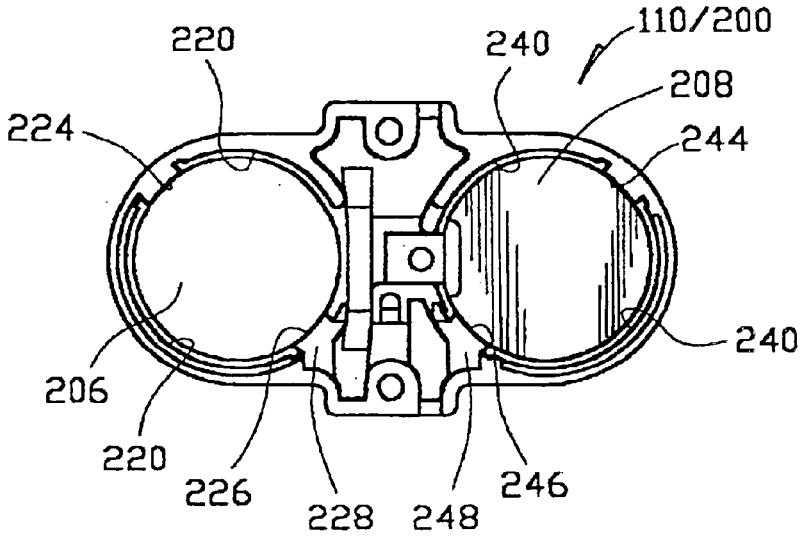
FIG. 3A is a top plan view of either body part of FIG. 3.
Figure 4:
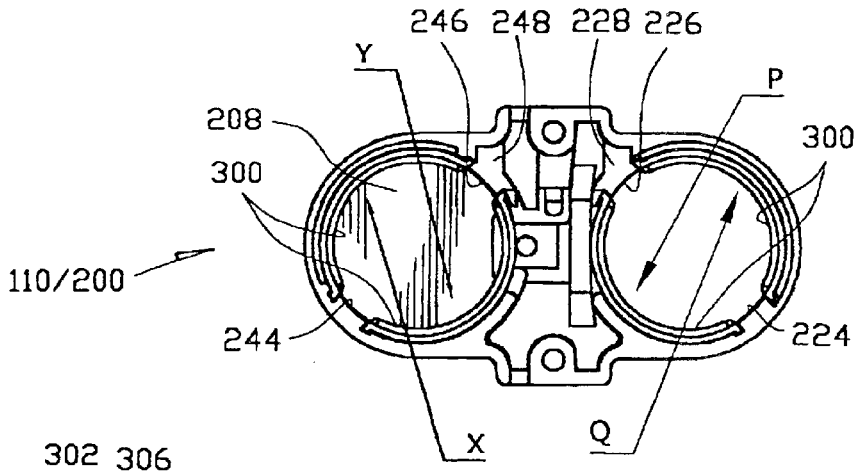
FIG. 4 is a top plan view corresponding to FIG. 3A, including the socket members.
Figure 4P:
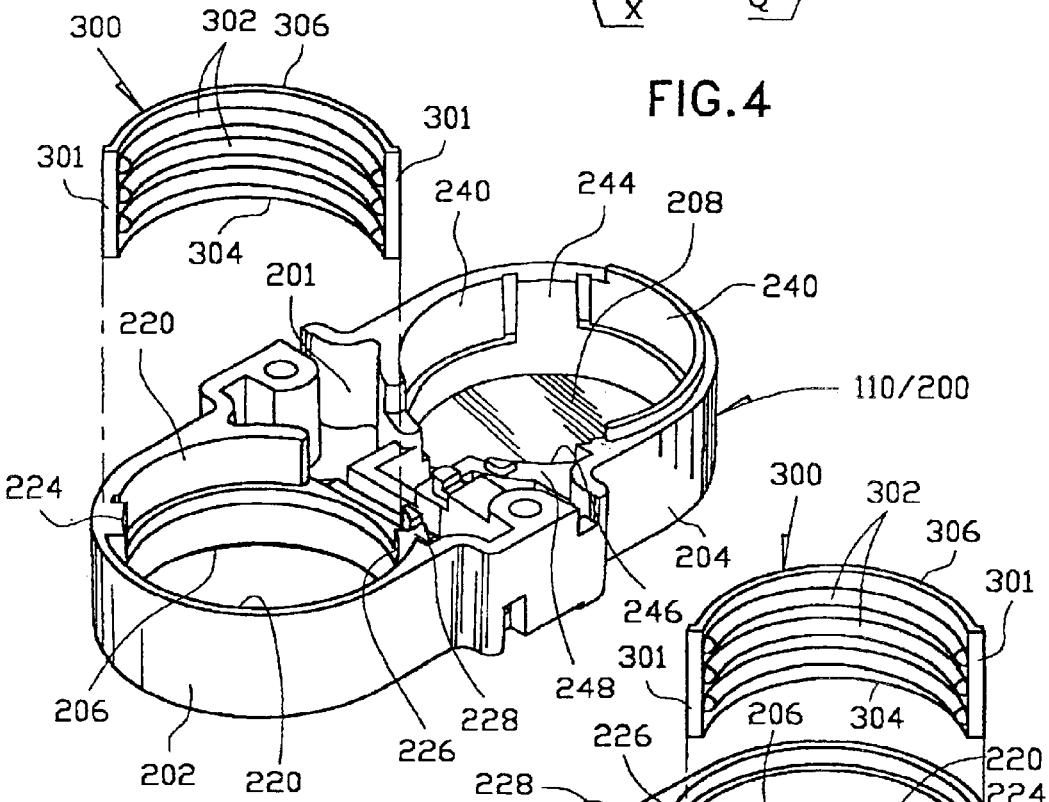
FIGS. 4P, 4Q, 4X and 4Y are perspective views of the body part of FIG. 4 taken in directions P, Q, X and Y respectively, showing how the corresponding socket members are located.
Figure 4Q:
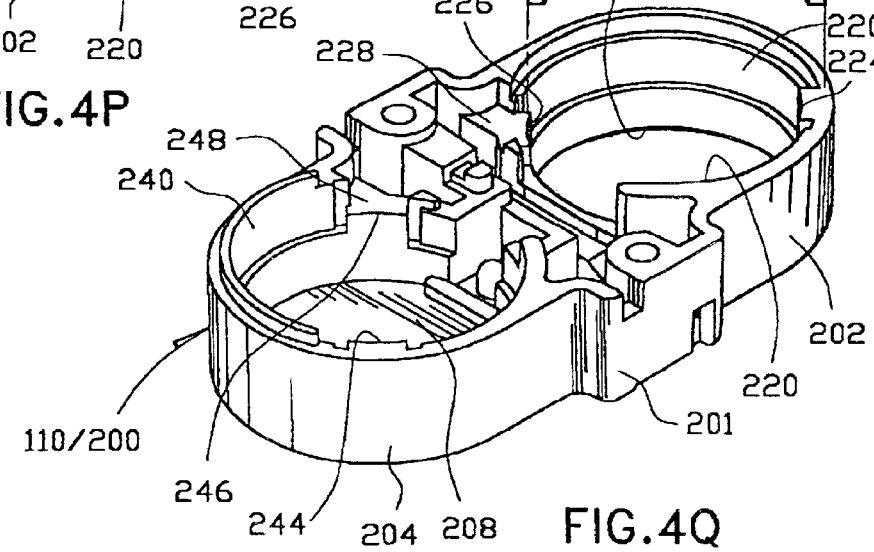
Figure 4X:
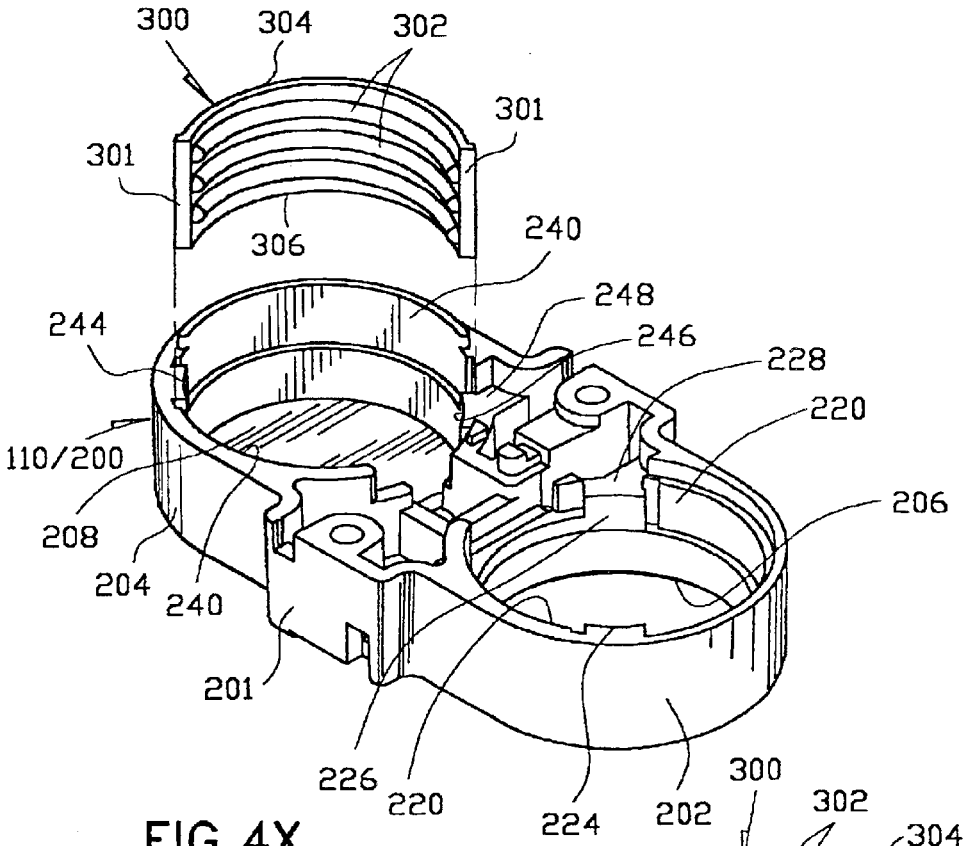
Figure 4Y:
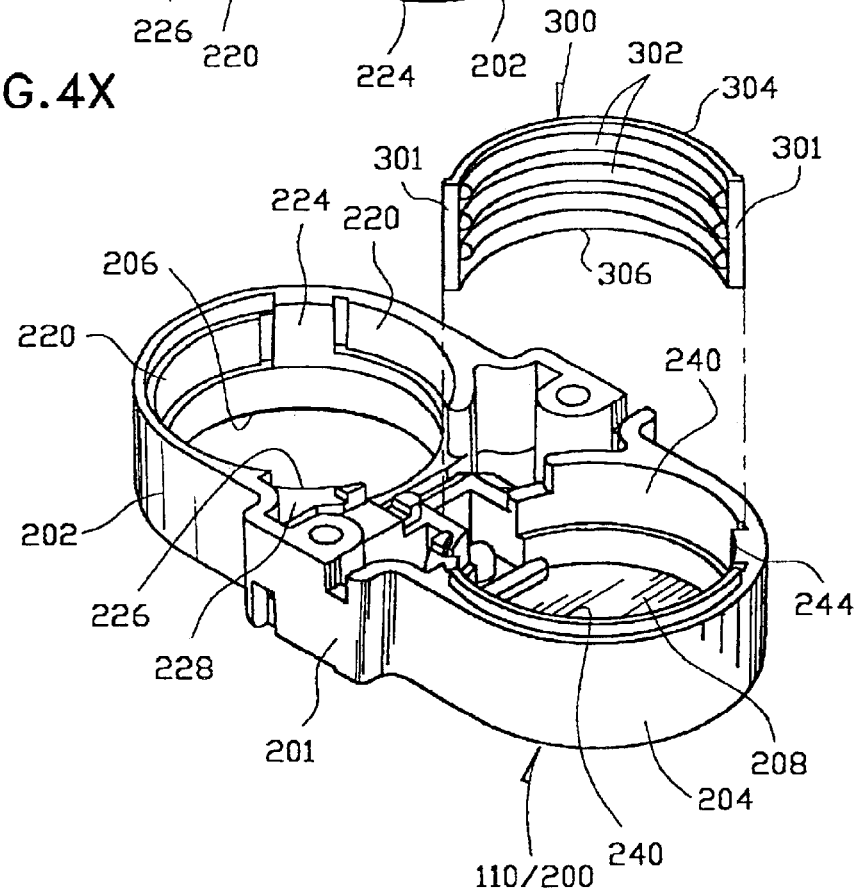
Figure 5:
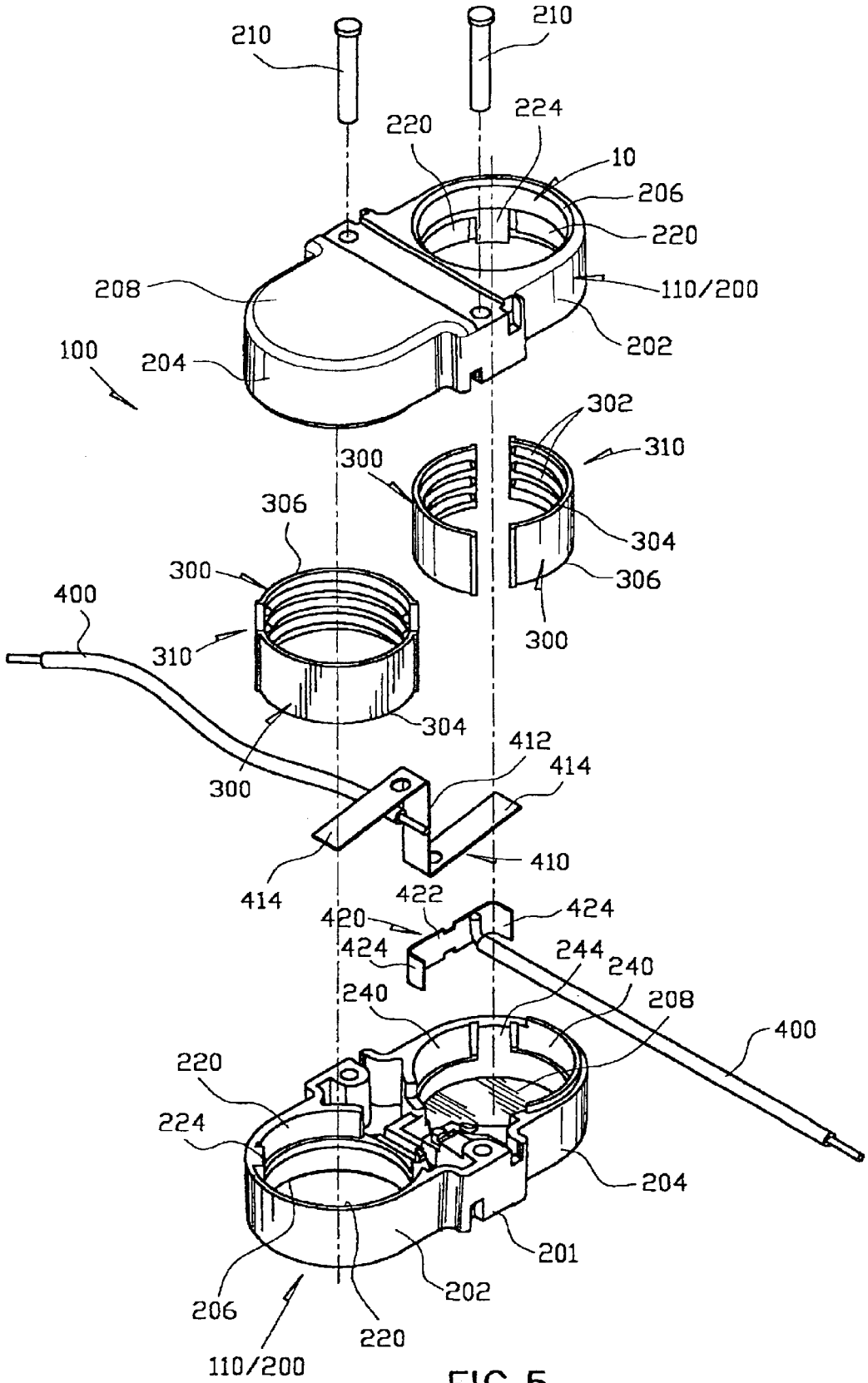
FIG. 5 is a fully exploded perspective view of the lamp socket of FIG. 2.

Referring initially to FIGS. 1 to 5 of the drawings, there is shown a first lamp socket 100 embodying the invention, which socket 100 has a body 110 formed by upper and lower separately moulded plastic hollow parts 200 and includes two pairs of separately moulded thin part-cylindrical plastic socket members 300. The socket body 110 defines a pair of cylindrical receptacles 10 facing in opposite directions, upwards and downwards, for locating or holding respective electric light bulbs 20. The two body parts 200 are preferably identical in construction and size, each having a narrow middle section 201 and a pair of opposite ends 202 and 204. The first end 202 is formed with a circular aperture 206 to define the open end of a respective receptacle 10, and the second end 204 has a solid wall 208 to define the closed end of the other receptacle 10.

Each receptacle 10 incorporates a respective pair of said socket members 300, which are located in the receptacle 10 diametrically opposing each other and together define substantially a cylindrical split collar 310 that is concentric with or shares a common axis with the receptacle 10. In each collar 310, the inner surfaces of the socket members 300 are moulded to form screw threads 302 for screwingly engaging a screw-threaded base 22 of the respective light bulb 20. The socket members 300 are preferably identical in construction and size, each extending over an angle slightly short of 180° and preferably in the range between 170° and 180°. Each socket member 300 has a relatively thin body, having a thickness that is comparable with or similar to the depth of the screw threads 302.

In this particular embodiment, each socket member 300 has opposite arcuate edges 304 and 306 that are both flat (continuous) and are indistinguishable from each other. Also, the screw threads 302 are positioned centrally between the two arcuate edges 304 and 306. As a result, each socket member 300 can be located in either orientation, upwards or downwards, in the relevant receptacle 10.

Each receptacle 10 is formed by the first end 202 of one body part 200 and the second end 204 of the other body part 200. The first end 202 of each body part 200 has a generally cylindrical inner surface, in which a pair of diametrically opposite shallow part-cylindrical recesses 220 is formed. The two recesses 220 are separated at opposite ends by a pair of diametrically opposite narrow unrecessed steps 224 and 226 of the said inner surface. Compared with the step 224, the other step 226 is relatively shorter and above which a gap 228 in the said inner surface is formed through to the middle section 201 of the body part 200 concerned.

The second end 204 of each body part 200 likewise has a generally cylindrical inner surface, in which a pair of diametrically opposite shallow part-cylindrical recesses 240 is formed. The two recesses 240 are likewise separated at opposite ends by a pair of diametrically opposite narrow unrecessed steps 244 and 246 of the said inner surface. Compared with the step 244, the other step 246 is relatively shorter and above which a gap 248 in the said inner surface is formed through to the middle section 201 of the body part 200 concerned.

Both types of the recesses 220 and 240 have an essentially flat bottom edge and generally the same arcuate length equal to that of the socket members 300. While the two body parts 200 are assembled together, each pair of recesses 220 and 240 at each end 202/204 of the body parts 200, one from each body part 200, are aligned and joined together to define a respective shallow part-cylindrical recessed space. This space has a shape and size matching with that of each socket member 300, for locating a respective socket member 300 in a fixed and almost tight fit manner.

Within each receptacle 10, the recesses 220 or 240 are positioned to locate the two socket members 300 at slightly different levels or axial positions with respect to the common axis. This results in the screw threads 302 of the socket members 300 at opposite ends, which are separated by the steps 224/226/244/246, being aligned as between the adjacent members 300, thereby completing a helical screw thread arrangement.

The lamp socket 100 includes a pair of electrical contact strips 410 and 420. The first contact strip 410 has a rectangular zigzag shape, consisting of a vertical central limb 412 to which a respective cable 400 is connected and a pair of horizontal end limbs 414 extending in opposite directions. This contact strip 410 is located inside the body 110, with the central limb 412 in the combined middle sections 201 of the body parts 200 and the end limbs 414 extending to lie on the solid walls 208 of the respective receptacles 10. The end limbs 414 act as respective contacts for the base end terminals of the corresponding light bulbs 20.

The second contact strip 420 has a straight section 422 to which a respective cable 400 is connected and a pair of opposite ends 424 that are bent to the same side. The contact strip 420 is located within one side of the body 110 and extends across the middle sections 201 of the body parts 200. The bends of the opposite ends 424 enter through the gaps 228 and 248 and slightly into the respective receptacles 10, where they act as respective contacts for the base side terminals of the corresponding light bulbs 20.

Prior to assembling the two body parts 200 together, all two pairs of socket members 300 are inserted into the corresponding recesses 220 and 240 at opposite ends 202 and 204 of one body part 200. Each socket member 300 is to be slid vertically down into the appropriate recess 220/240, through the open upper side thereof, as illustrated in FIGS. 4P, 4Q, 4X and 4Y. The two contact strips 410 and 420 are put in place at suitable time, with their cables 400 threaded out from one side of the body part 200 through appropriate openings.

The other body part 200 is then carefully closed down onto the first body part 200, with its recesses 220 and 240 at opposite ends 202 and 204 fitting over the exposed upper halves of the corresponding socket members 300. Finally, the two body parts 200 are secured together by means of two rivets 210 passing through opposite ends of the combined middle sections 201.

It is noted that opposite ends of each socket member 300 have respective slightly inclined surfaces 301 (inclined from the radial direction) and the associated recesses 220 and 240 are formed with correspondingly inclined opposite end surfaces for engaging the respective surfaces 301 to lock the socket member 300 in the combined recesses 220 and 240.

Figure 6:
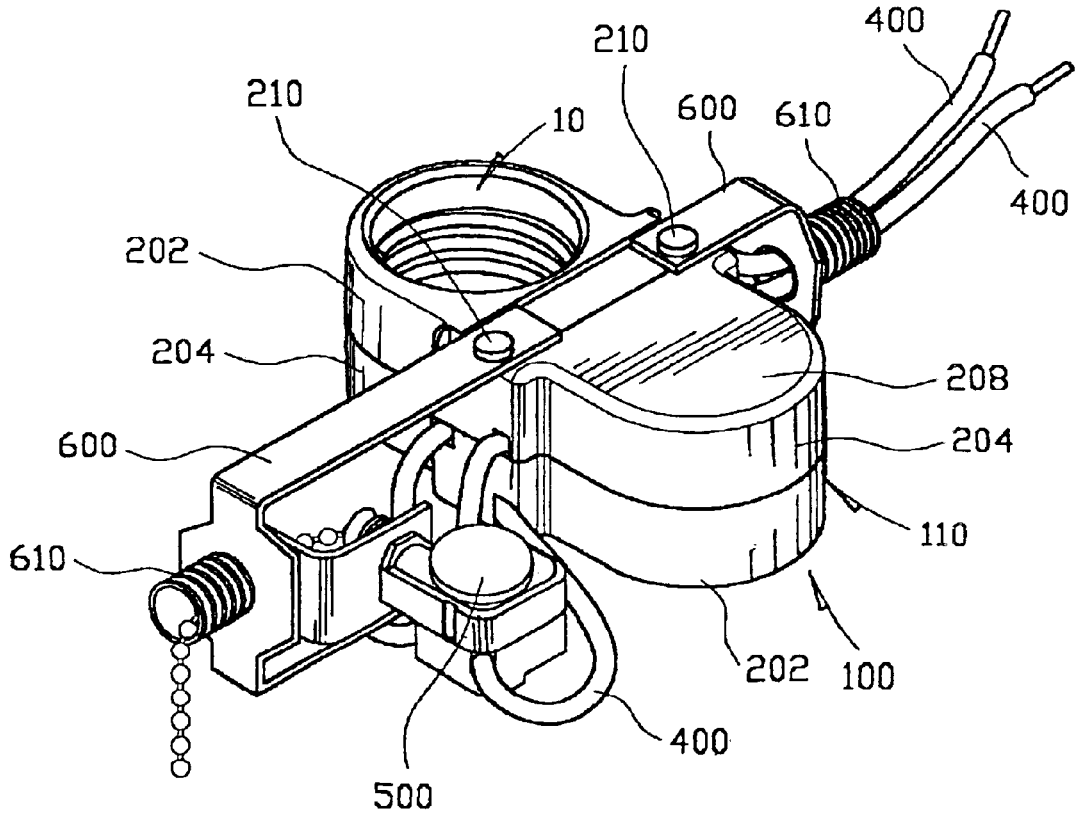
FIG. 6 is a perspective view of the lamp socket of FIG. 1, including a rotary switch and mounting brackets.

As shown in FIG. 6, the lamp socket 100 may be provided with an external pull-chain rotary stepping switch 500 that is connected in circuit with one of the two cables 400. A pair of mounting brackets 600 is connected to the socket body 110 by means of the rivets 210. The brackets 600 include respective screw-threaded tubular connectors 610 at opposite ends for mounting the lamp socket 100 onto a support for use. The switch 500 is located on one of the brackets 600.

Figure 7:
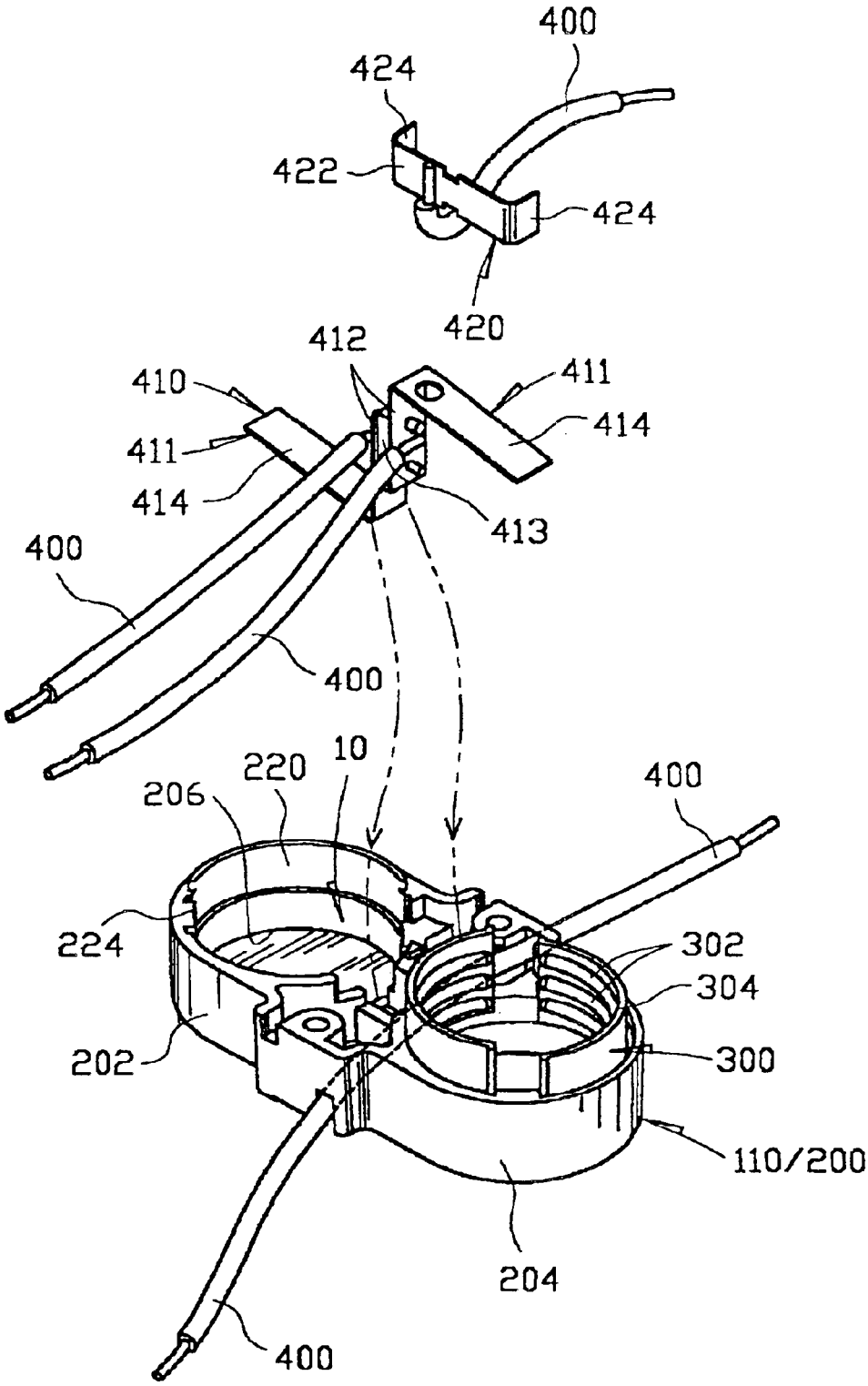
FIG. 7 is a perspective view corresponding to FIG. 5, showing certain components including a modified contact strip.
Figure 8:
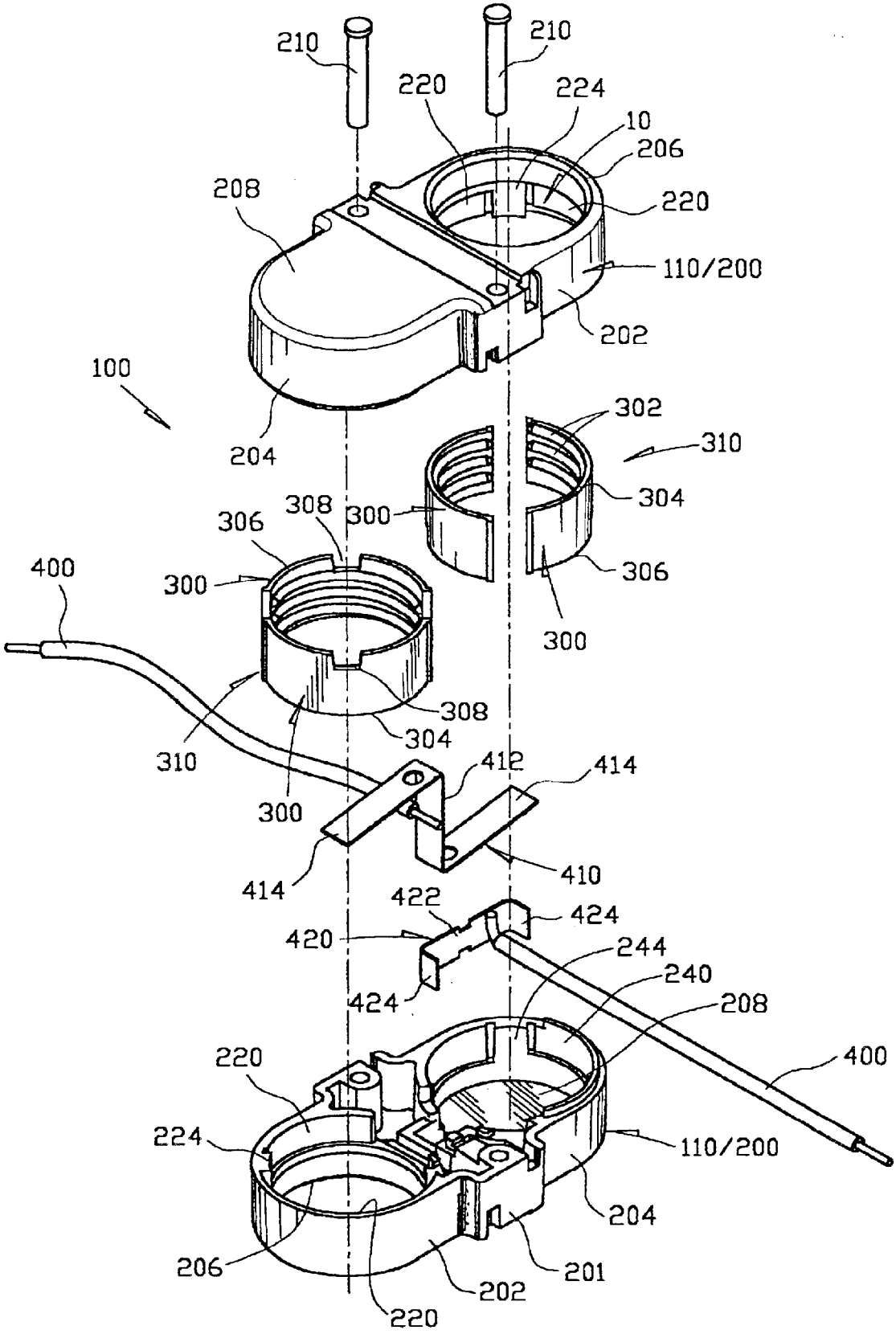
FIG. 8 is an exploded perspective view of a second embodiment of a lamp socket in accordance with the invention, said socket having a body and socket members that are slightly different.
Figure 9X:
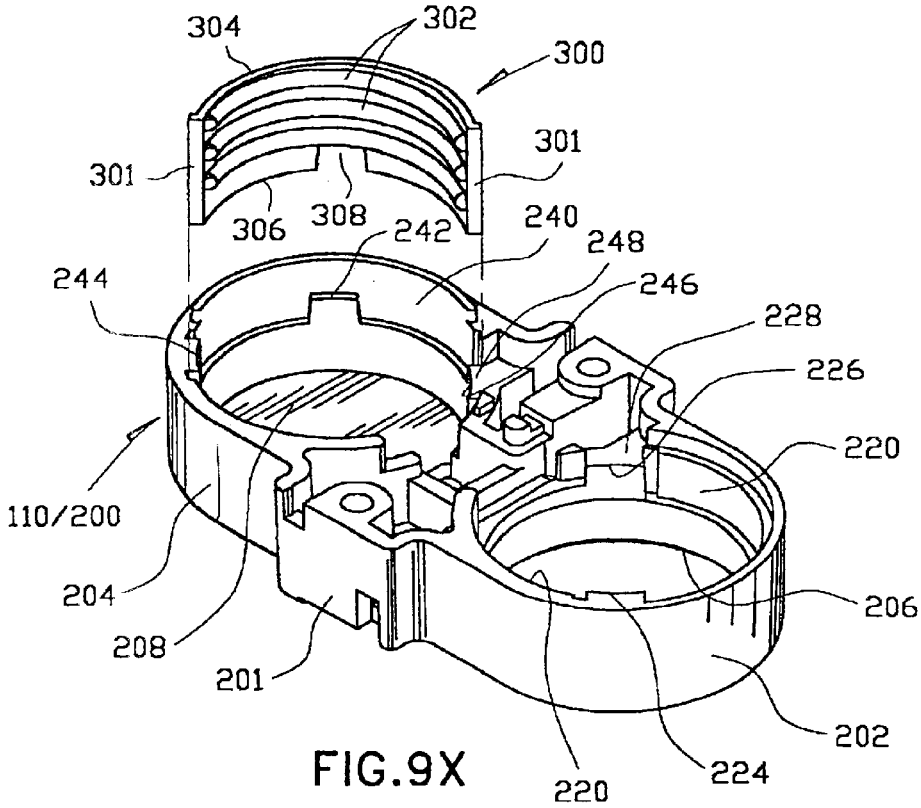
FIGS. 9P, 9Q, 9X and 9Y are perspective views of the body part of FIG. 9 taken in directions P, Q, X and Y respectively, showing how the corresponding socket members are located.
Figure 9Y:
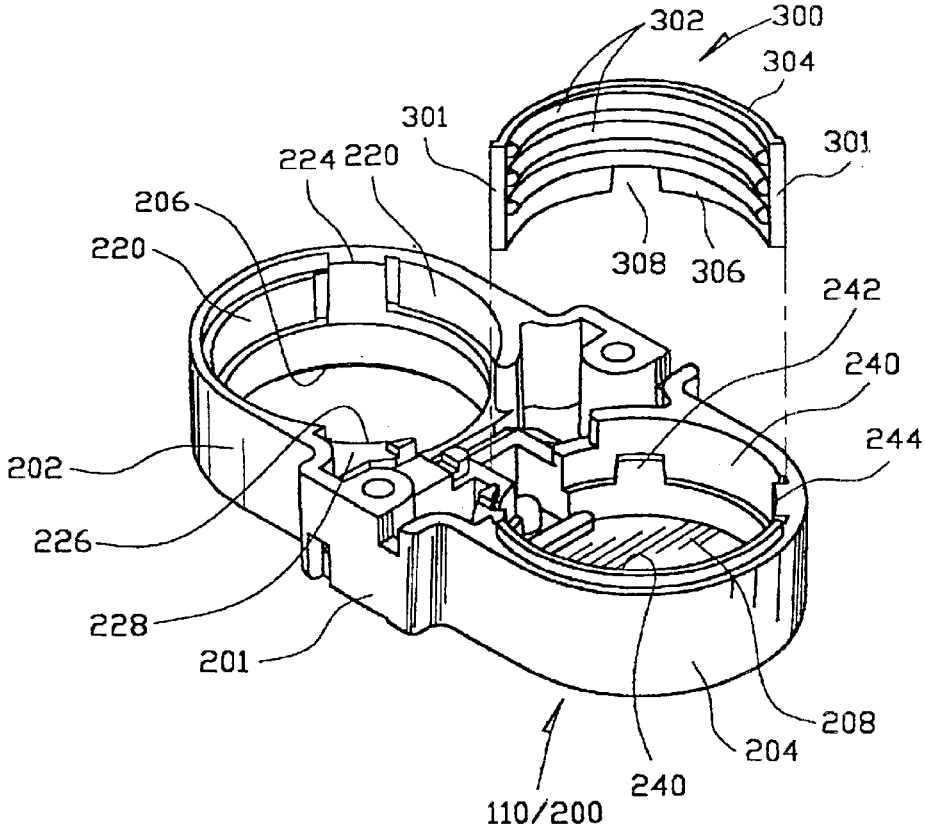
Figure 9:
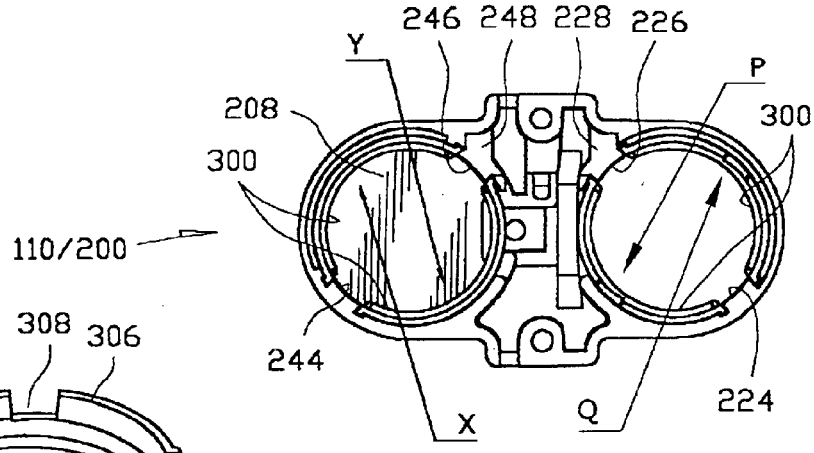
FIG. 9 is a top plan view of either one of two parts of the body of FIG. 8 and the socket members.
Figure 9P:
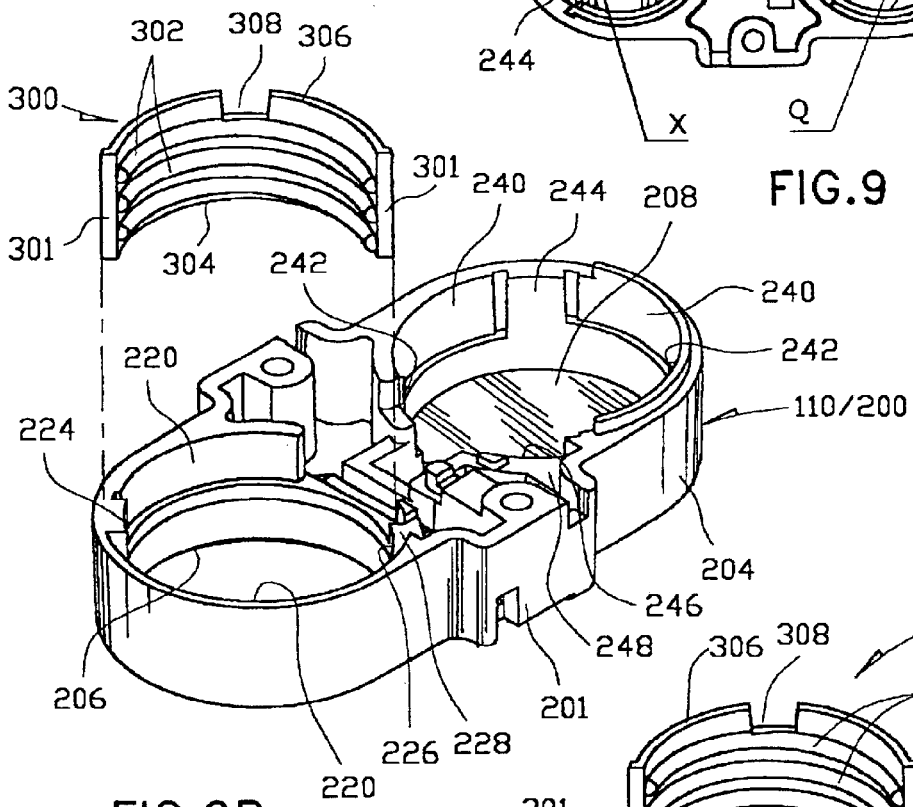
Figure 9Q:
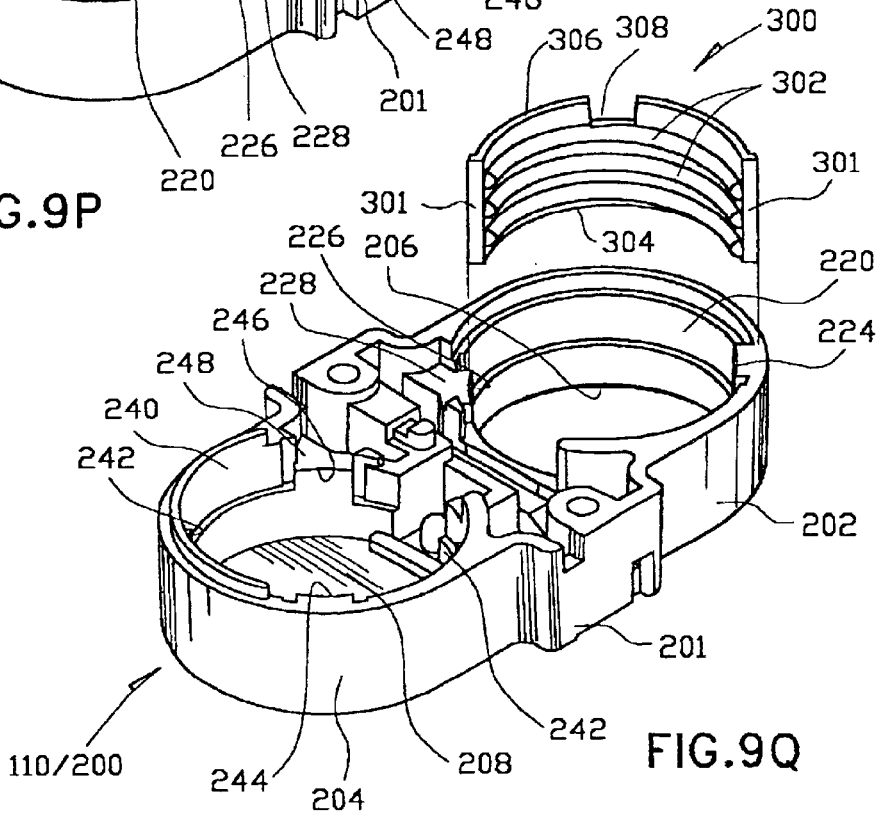

In a slightly different construction as shown in FIG. 7, the first contact strip 410 is formed by a pair of L-shaped strips 411 which are connected in a reversed and back-to-back manner together to form the same rectangular zigzag shape. The two strips 411 are separated by means of an electrically insulating strip 413 in-between, thereby resulting in the presence of two said central limbs 412. Each of the central limbs 412 is connected with a respective said cable 400 to form a separate circuit for individual switching of the corresponding light bulb 20.

Reference is now made to FIGS. 8, 9, 9P, 9Q, 9X and 9Y of the drawings, there is shown a second lamp socket 100 embodying the invention, which has the substantially the same construction as the first lamp socket 100, with the equivalent components designated by the same reference numerals. The differences lie in the socket members 300 and their locating recesses 220 and 240.

In this second embodiment, the arcuate edges 304 and 306 of each socket member 300 are asymmetrical compared with each other, in that the arcuate edge 306 is formed with a small rectangular notch 308, whereas the other arcuate edge 304 remains flat. Also, each recess 240 has a bottom edge including a small rectangular protruding step 242 formed by an unrecessed short portion of the cylindrical inner surface of the body part second end 204, whereas each of the other recesses 220 has a bottom edge that remains essentially flat.

The step 242 of each recess 240 matches with the notch 308 of the corresponding socket member 300, i.e. having substantially the same shape, size and relative location, for inter-engagement to determine the orientation, upwards or downwards, at which the socket member 300 is fitted into the associated recesses 220 and 240. That is to say, its arcuate edge 306 having a said notch 308 should fit into a respective recess 240 having a said step 242 and/or its flat arcuate edge 304 should fit into a respective recess 220 having a said flat bottom edge.

The orientation at which the socket member 300 is fitted into the respective recesses 220 and 240 is relevant, as required in certain circumstances, in order to achieve the aforesaid helical alignment of the screw threads 302 at opposite ends between adjacent socket members 300. Such circumstances include the situation where the screw threads 302 of each socket member 300 are not positioned centrally between the two arduate edges 304 and 306, and/or the situation where the recesses 220 or 240 of each receptacle 10 are formed at the same level. The angle and pitch of the screw threads 302 and the arcuate length of the socket members 300 are also relevant factors.

It is envisaged that each receptacle may incorporate more than two part-cylindrical socket members, in which case the socket members are made suitably shorter and arranged in a generally equiangular, annular manner on the inner surface of the receptacle.

Apart from the contact strips 410 and 420 that must be made of metal, all the other components of the described lamp socket 100 can be produced using moulding operations and made of plastics material or the like such as bakelite for example. As plastics or bakelite material is relatively cheap and moulding operations can be performed at a high speed, low cost mass production of lamp sockets is possible.

The invention has been given by way of example only, and various other modifications of and/or alterations to the described embodiments may be made by persons skilled in the art without departing from the scope of the invention as specified in the appended claims.

What is claimed is:

1. A lamp socket for holding at least one electric light source having a screw-threaded base, comprising a body formed by upper and lower separate moulded plastic hollow parts and defining therein a receptacle for receiving and locating said light source by its base about an axis, at least two separately moulded part-cylindrical socket members in at least one of the upper and lower plastic hollow parts, said socket members each having an inner surface and screw threads on the inner surface for engaging the base of said light source, and a pair of electrical contacts arranged within the receptacle for contact by respective side and end terminals on the base of said light source, wherein the upper part forms at one end with an aperture to define an open end of the receptacle and the lower part forms at the other end with a solid wall to define a closed end of the receptacle.

2. The lamp socket as claimed in claim 1, wherein each of the socket members has a body of a thickness similar to the depth of the screw threads of said socket member.

3. The lamp socket as claimed in claim 1, wherein the socket members have substantially the same construction as one another.

4. The lamp socket as claimed in claim 3, wherein each socket member has opposite arcuate edges and its screw threads are formed at a substantially central position between the two edges.

5. The lamp socket as claimed in claim 3, wherein the socket members are located within the receptacle at different levels with respect to the axis such that their screw threads at opposite ends are aligned as between adjacent socket members.

6. The lamp socket as claimed in claim 1, wherein a pair of said socket members is incorporated, which are located on diametrically opposite sides within the receptacle.

7. The lamp socket as claimed in claim 6, wherein each socket member extends over an angle slightly short of 180°.

8. The lamp socket as claimed in claim 1, wherein the socket members are arranged in an annular manner to form substantially a split collar.

9. The lamp socket as claimed in claim 1, wherein the receptacle has a generally cylindrical inner surface formed with part-cylindrical recesses locating therein the socket members respectively.

10. The lamp socket as claimed in claim 9, wherein opposite ends of each socket member and the corresponding recess have respective inclined surfaces for inter-engagement to hold the socket member in the recess.

11. The lamp socket as claimed in claim 9, wherein each socket member has opposite arcuate peripheral sides that are asymmetrical compared with each other and the corresponding recess has a matching shape, whereby the orientation at which the socket member is fitted within the recess is determined.

12. The lamp socket as claimed in claim 11, wherein one arcuate peripheral side of each socket member is formed with a notch and the corresponding recess is formed with a protrusion matching with the notch for engagement therewith to determine the orientation at which the socket member is fitted within the recess.

13. The lamp socket as claimed in claim 1, for holding two electric light sources, wherein the upper and lower separate moulded plastic hollow parts has opposite ends defining two receptacles facing in opposite directions for locating said two sources respectively, with a first end of each body part formed with said aperture to define an open end of one receptacle and a second end of each body part having a said solid wall to define a closed end of the other receptacle.

14. The lamp socket as claimed in claim 13, wherein the two body parts have substantially the same construction as each other.

15. The lamp socket as claimed in claim 1, wherein the body and the socket members are moulded from plastics material.

* * * * *